US008840846B2

(12) United States Patent
Bhattacharyya et al.

(10) Patent No.: US 8,840,846 B2
(45) **Date of Patent: *Sep. 23, 2014**

(54) METHOD AND APPARATUS FOR CATALYTIC CRACKING

(75) Inventors: Debasis Bhattacharyya, Faridabad (IN); Gadari Saidulu, Faridabad (IN); Arumugam Velayutham Karthikeyani, Faridabad (IN); Pankaj Kasliwal, Faridabad (IN); Bandaru Venkata Hari Prasad Gupta, Faridabad (IN); Ram Mohan Thakur, Faridabad (IN); Jagdev Kumar Dixit, Faridabad (IN); Sudipta Roy, Faridabad (IN); Ganga Shanker Mishra, Faridabad (IN); Satyen Kumar Das, Faridabad (IN); Santanam Rajagopal, Faridabad (IN)

(73) Assignee: Indian Oil Corporation Ltd., Kolkata (IN)

( * ) Notice: Subject to any disclaimer, the term of this patent is extended or adjusted under 35 U.S.C. 154(b) by 0 days.

This patent is subject to a terminal disclaimer.

(21) Appl. No.: 13/638,509

(22) PCT Filed: Mar. 30, 2011

(86) PCT No.: PCT/IN2011/000221

§ 371 (c)(1),
(2), (4) Date: Oct. 1, 2012

(87) PCT Pub. No.: WO2011/121612

PCT Pub. Date: Oct. 6, 2011

(65) Prior Publication Data

US 2013/0020234 A1 Jan. 24, 2013

(30) Foreign Application Priority Data

Mar. 31, 2010 (IN) ..... 794/DEL/2010

(51) Int. Cl.
*B01J 8/00* (2006.01)
*C10G 11/18* (2006.01)

(Continued)

(52) U.S. Cl.
CPC ..... *C10G 11/18* (2013.01); *C10G 2300/4093* (2013.01); *C10G 25/00* (2013.01); *C10G 25/12* (2013.01); *C10G 2400/28* (2013.01); *C10G 2400/02* (2013.01); *C10G 55/06* (2013.01); *C10G 2300/201* (2013.01); *C10G 2400/20* (2013.01)
USPC ..... 422/187; 422/129; 422/139; 422/140; 422/141; 422/142; 422/143; 422/144; 422/145; 422/146; 422/147; 208/85

(58) Field of Classification Search
CPC ..... B01J 19/00; B01J 8/00; B01J 8/0055; B01J 8/1836; B01J 8/26; B01J 8/18; A01N 59/00; A01N 37/16; C10G 2300/301; C10G 2400/04; C10G 2400/20; C10G 2300/202; C10G 2300/4081; C10G 2300/1074; C10G 2300/107; C10G 9/00; C10G 1/00; C07C 7/144; C07C 1/00; B01D 1/00; B01D 53/00; B01D 53/14
USPC ..... 422/129, 139–147; 208/46, 49, 67, 72, 208/73, 85, 88, 91, 140, 146, 149, 177, 208/208 R, 209, 213
See application file for complete search history.

(56) References Cited

U.S. PATENT DOCUMENTS 2,378,531 A 6/1945 Becker
4,892,643 A * 1/1990 Herbst et al. ..... 208/70

(Continued)

FOREIGN PATENT DOCUMENTS

EP 1 013 743 A1 6/2000

*Primary Examiner* — Natasha Young
(74) *Attorney, Agent, or Firm* — Maschoff Brennan

(57) ABSTRACT

An apparatus for catalytic cracking of feedstock includes a first channel in which a feedstock is treated with an adsorbent to obtain a treated intermediate. The apparatus further comprises a separator-reactor vessel. The separator-reactor vessel includes an adsorbent separating region to remove the adsorbent from the treated intermediate. The separator-reactor vessel further includes a second channel connected to the adsorbent separating region. The treated intermediate is contacted with a catalyst in the second channel to produce a cracking yield. The second channel terminates in a catalyst separating region of the separator-reactor vessel. The catalyst is removed from the cracking yield in the catalyst separating region. The separator-reactor vessel further includes a physical partition disposed between the adsorbent separating region and the catalyst separating region to separate the two regions.

22 Claims, 2 Drawing Sheets

(51) Int. Cl.

| | |
|---|---|
| ***C10G 25/00*** | (2006.01) |
| ***C10G 25/12*** | (2006.01) |
| ***C10G 55/06*** | (2006.01) |
| *B01J 7/00* | (2006.01) |
| *B01J 8/18* | (2006.01) |
| *B01J 19/00* | (2006.01) |
| *B01J 19/24* | (2006.01) |
| *B01J 35/00* | (2006.01) |
| *B01J 35/02* | (2006.01) |
| *C10G 1/00* | (2006.01) |

(56) References Cited

U.S. PATENT DOCUMENTS

| | | | | |
|---|---|---|---|---|
| 4,971,766 | A * | 11/1990 | Chen et al. | 422/144 |
| 5,057,205 | A * | 10/1991 | Chin et al. | 208/121 |
| 6,149,875 | A * | 11/2000 | Rao et al. | 422/144 |
| 6,656,344 | B1 * | 12/2003 | Rao et al. | 208/113 |
| 7,008,595 | B2 * | 3/2006 | Pankaj et al. | 422/141 |
| 7,381,322 | B2 * | 6/2008 | Pankaj et al. | 208/213 |
| 2004/0140246 | A1 * | 7/2004 | Lomas | 208/134 |
| 2006/0096890 | A1 | 5/2006 | Pankaj et al. | |
| 2008/0105595 | A1 * | 5/2008 | Koseoglu | 208/91 |
| 2013/0168289 | A1 * | 7/2013 | Saidulu et al. | 208/73 |

* cited by examiner

METHOD AND APPARATUS FOR CATALYTIC CRACKING

TECHNICAL FIELD

The subject matter described herein, in general, relates to cracking of feedstock and, in particular, relates to catalytic cracking of feedstock.

BACKGROUND

Generally, crude oil is refined in refineries to yield products, such as gasoline, diesel, and liquified petroleum gas (LPG), along with some other by-products. Such by-products include considerable amounts of heavy residues, which have to be upgraded to meet environmental legislations. The heavy residues can be used as feedstock in processes such as catalytic cracking, in which the heavy residues are contacted with a catalyst to obtain an additional yield of cracking products.

However, these heavy residues generally include contaminants, such as carbon residue, metal impurities, and basic nitrogen and sulphur compounds. These contaminants can adversely affect the catalytic cracking of the heavy residues. For example, the carbon residue may form carbonaceous deposits on the catalyst and thus reduce catalyst activity during processing of the feedstock. Further, certain metal impurities such as Nickel and Vanadium present in the heavy residues may accumulate on the catalyst and may lead to subsequent deactivation of the catalyst and undesirable hydrogen and coke formation.

Conventionally, during the catalytic cracking of heavy residues, the contaminants in the heavy residues are first separated from the feedstock to protect the catalyst from the contaminants. The separation may be achieved using various techniques, such as residue hydro-demetallation, residue desulphurization and metal passivation. However, these techniques require additional secondary processes, thus adding to the cost of processing the heavy residues. Further, techniques such as metal passivation require frequent changes in operating conditions of the catalytic cracking apparatus, which may render the operation of the apparatus ineffective in terms of cost.

In addition to the above mentioned techniques, techniques such as contaminant adsorption are also used conventionally. Such techniques employ a mixture of catalyst and adsorbent, in which the adsorbent removes the contaminants from the catalyst. Further, these techniques use physically separable mixtures of the catalyst and the adsorbent so that the adsorbent and the catalyst can be separated from each other by physical techniques, for example, under the effect of gravitational force (under fluidization conditions) or by using magnetic force, after the completion of the catalytic cracking. However, in such techniques, physical properties, for example, particle size and density, of the catalyst and the adsorbent have to be appropriately selected so that they may be separated easily. Hence, these techniques are limited by the physical properties of the adsorbent and the catalyst, and are usually economically unviable.

SUMMARY

The subject matter described herein is directed to methods and apparatus for catalytic cracking of feedstock.

According to an embodiment of the present subject matter, an apparatus for catalytic cracking of feedstock includes a first channel and a separator-reactor vessel. A feedstock is treated with an adsorbent in the first channel to produce a treated intermediate. The first channel terminates in an adsorbent separating region of the separator-reactor vessel. The adsorbent separating region is provided to remove the adsorbent from the treated intermediate. The separator-reactor vessel further includes a second channel to contact the treated intermediate with a catalyst. On contact with the catalyst, the treated intermediate is converted to a cracking yield in the second channel. The second channel terminates in a catalyst separating region of the separator-reactor vessel. The catalyst separating region is provided to remove the catalyst from the cracking yield. The adsorbent separating region and the catalyst separating region are separated by a physical partition disposed in the separator-reactor vessel between the adsorbent separating region and the catalyst separating region.

The described methods and apparatus achieve a removal of the contaminants from the feedstock stream and generation of cracking yield. Further, the catalyst contacts the treated intermediate after the removal of the contaminants and hence, the contamination of the catalyst is substantially reduced. Consequently, catalyst addition rate is reduced, which considerably reduces the cost of operation. The overall performance of the catalyst is also enhanced. Further, the method facilitates separate regeneration of the adsorbent and the catalyst. Hence, the physical properties of the catalyst and the adsorbent, such as particle size, particle density, and fluidization characteristics, can be selected independent of each other, which renders the methods and apparatus effective in terms of cost.

These and other features, aspects, and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter.

BRIEF DESCRIPTION OF DRAWINGS

The above and other features, aspects, and advantages of the subject matter will be better understood with regard to the following description, appended claims, and accompanying drawings where:

DETAILED DESCRIPTION

Figure 1:
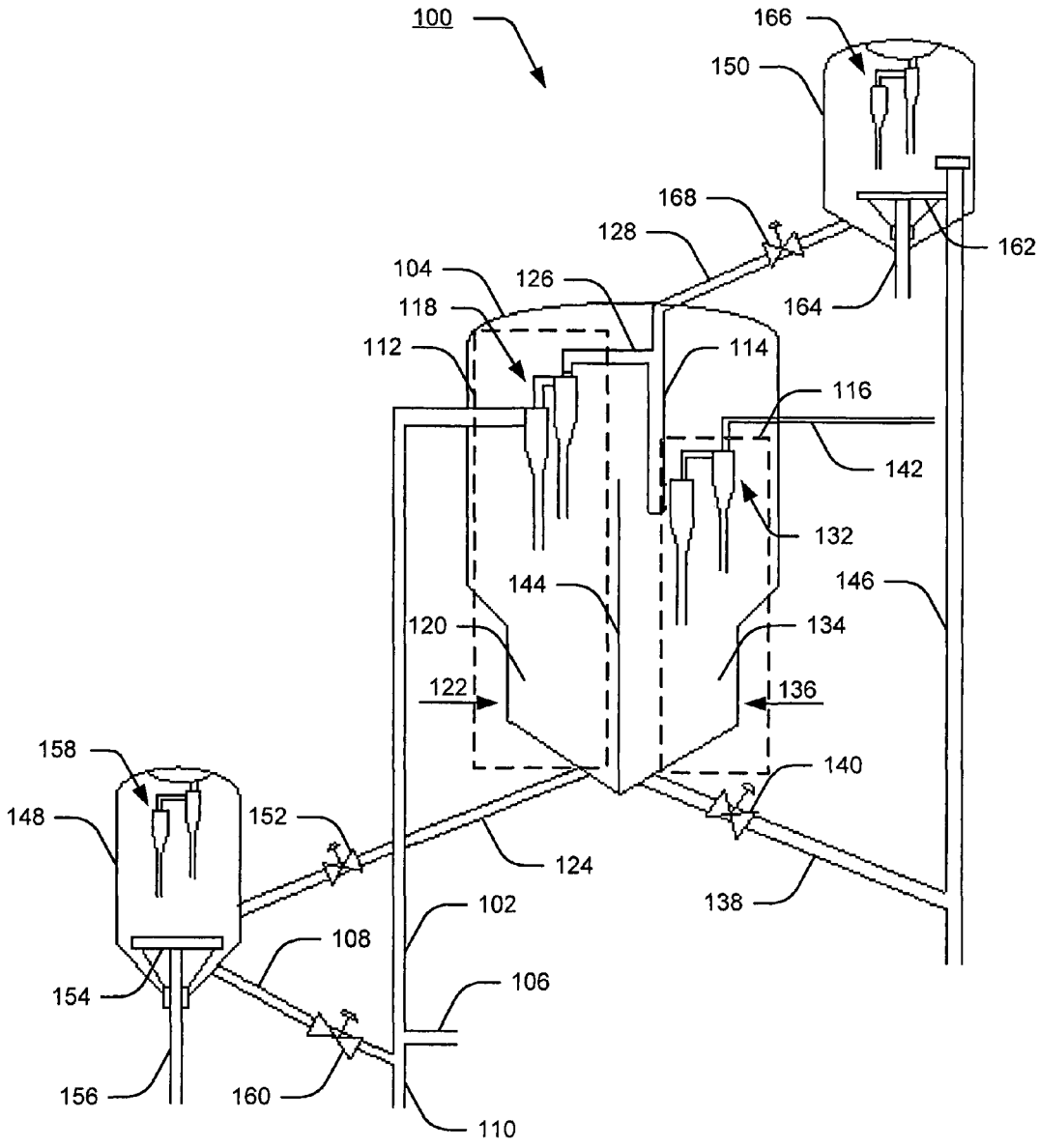
FIG. 1 illustrates an exemplary apparatus for catalytic cracking of feedstock, according to an embodiment of the present subject matter.

Apparatus and method(s) for catalytic cracking of heavy feedstock are described herein. The feedstock may be a heavy hydrocarbon obtained, for example, after refining of crude oils. The feedstock may also include, for example, residual oils from a vacuum tower, residual oils from an atmospheric tower, and heavy vacuum gas oils. Such feedstock may have contaminants, for example, carbon residue, Nitrogen and Sulphur compounds, and metal impurities, such as Nickel, Vanadium, and Sodium. To increase refinery margins and to meet environmental legislations, the feedstock is processed using processes such as catalytic cracking. In such processes, the feedstock is processed in the presence of a catalyst, under predetermined conditions of temperature, to obtain a cracking yield, for example, light hydrocarbon products. However, the contaminants present in the feedstock have a detrimental effect on the catalyst, and in turn, on the efficiency of the process employed for cracking the feedstock.

According to an embodiment of the present subject matter, an adsorbent is employed to remove the impurities from the feedstock before the feedstock is treated with a catalyst. In said implementation, the feedstock is contacted with an adsorbent to substantially remove the contaminants from the feedstock. Further, the temperature of the feedstock-adsorbent mixture is maintained so that the feedstock undergoes thermal cracking to produce intermediate products. The adsorbent having the contaminants adsorbed thereon is interchangeably referred to as spent adsorbent hereinafter, and the intermediate products obtained after removal of the contaminants and thermal cracking are interchangeably referred to as treated intermediate hereinafter. Further, the treated intermediate, substantially free from the contaminants, is separated from the spent adsorbent and the spent adsorbent is sent for regeneration.

The treated intermediate, on the other hand, is brought in contact with a catalyst. The treated intermediate is catalytically converted into cracking yield, such as light olefins, Ethylene, Propylene, Butylenes and high octane gasoline, and liquefied petroleum gas (LPG). During the conversion of the treated intermediate, the catalyst may get contaminated with wastes, such as coke, which may lead to deactivation of the catalyst. Such a deactivated catalyst contaminated with wastes is interchangeably referred to as spent catalyst hereinafter. The spent catalyst is separated from the cracking yield and is regenerated.

Since, the removal of the contaminants from the feedstock by the adsorbent is achieved before the catalytic cracking of the treated intermediate by the catalyst, the effect of the contaminants on the catalyst is substantially less. Hence, the life of the catalyst is enhanced, and the catalyst addition rate and the cost of operation are considerably reduced. Further, since the spent adsorbent and the spent catalyst are regenerated separately, the method is independent of the physical properties of the catalyst and the adsorbent, such as particle size, particle density, and fluidization, and is, hence, effective in terms of cost.

FIG. 1 illustrates an exemplary apparatus 100 to achieve catalytic cracking of feedstock, in accordance with an embodiment of the present subject matter. The feedstock may be for example, residual oils from a vacuum tower, residual oils from an atmospheric tower, and heavy vacuum gas oils. The feedstock may have contaminants, such as carbon residue, metal impurities including Vanadium, Nickel, Sodium, etc., and compounds of Nitrogen, Sulphur, etc. In one example, the feedstock has carbon residue in excess of 5% by weight and metal impurities in excess of 10 parts per million (ppm).

The apparatus 100 may include a first channel 102 and a separator-reactor vessel 104. In an embodiment, the first channel 102 is an upflow reactor, also referred to as a riser reactor. In said embodiment, the first channel 102 is connected to a feedstock input 106 to supply the feedstock to the first channel 102. The feedstock may be supplied along with a heated gas, such as steam, to preheat the feedstock and to assist in partial vaporization of the feedstock. In an implementation, the heated gas is about 10-50% of the weight of the feedstock.

Further, a first standpipe 108 is connected to the first channel 102. In an implementation, the first standpipe 108 supplies an adsorbent to the first channel 102. The adsorbent may include Alumina, Silica-Alumina, Silica-Magnesia, kaolin clay, etc., or a mixture thereof. The adsorbent may further include, for example, V-trap material or an inactive catalyst. The adsorbent may exhibit acidic or non-acidic properties. Further, the adsorbent may be provided as microspheres, such that a large surface area is available for the adsorption of the contaminants in the feedstock. In an implementation, the surface area of the adsorbent particles is about 60 square meters per gram ($m^2$/gm).

The first channel 102 is further supplied with a lifting medium from a lifting medium input 110. The lifting medium fluidizes the adsorbent at the bottom of the first channel 102 till the feedstock is supplied through the feedstock input 106. Thereafter, the adsorbent particles are lifted mainly by the feedstock vapors. In an implementation, steam is used as the lifting medium. However, other gases, such as fuel gas, Ethane, Propane, Nitrogen, or light naphtha, can also be used as the lifting medium. The lifting medium may also assist in further vaporization of the feedstock. The lifting medium maintains a superficial velocity of the adsorbent in a range of about 2 meters per second to about 5 meters per second in the bottom of the first channel 102 before feedstock is introduced. In an implementation, the superficial velocity of the vapor is maintained in such a way that a residence time of the adsorbent in the first channel 102 is in a range of about 1 to 5 seconds. In another implementation, the residence time of the adsorbent can be maintained in a range of about 2 to 3 seconds.

The adsorbent introduced in the first channel 102 is typically at a high temperature. As the feedstock contacts the adsorbent in the first channel 102, the feedstock gets vaporized. The vaporization of the feedstock increases the volumetric flow rate of the feedstock, which facilitates the feedstock-adsorbent mixture to proceed further along the first channel 102. Further, as the temperature of the feedstock in the first channel 102 increases on contacting the adsorbent, thermal cracking of the feedstock takes place in the first channel 102. In an implementation, the thermal cracking of the feedstock breaks heavy molecules of the feedstock into smaller molecules, which are capable of passing through the narrow pores of a catalyst. Further, in the first channel 102, the adsorbent removes the contaminants, such as carbon residue, metal impurities, and Nitrogen and Sulphur compounds, present in the feedstock. Hence, the treatment of the feedstock with the adsorbent in the first channel 102 results in a treated intermediate, which is substantially free from the contaminants and is composed of smaller molecules. Along with the treated intermediate, the adsorbent with the contaminants adsorbed thereon is also obtained from the first channel 102. Such an adsorbent which is obtained after adsorption of contaminants is referred to as spent adsorbent hereinafter. The treated intermediate and the spent adsorbent are directed further along the first channel 102 to the separator-reactor vessel 104.

The separator-reactor vessel 104 includes an adsorbent separating region 112, a second channel 114 and a catalyst separating region 116. In one implementation, the spent adsorbent is removed from the treated intermediate in the adsorbent separating region 112. The treated intermediate is then contacted with a catalyst in the second channel 114 where the treated intermediate undergoes catalytic cracking to produce a cracking yield. In the process of catalytic cracking, the catalyst loses its activity and a substantially inactive catalyst is obtained at the end of the catalytic cracking process. The substantially inactivated catalyst is referred to as spent catalyst hereinafter. The cracking yield is then separated from the spent catalyst in the catalyst separating region 116.

According to an aspect of the present subject matter, the adsorbent separating region 112 of the separator-reactor vessel 104 may include a quenching medium input (not shown in the figure). In an embodiment, the quenching medium input is provided at an outlet of the first channel 102. The quenching medium input supplies a quenching medium, such as steam, to reduce the temperature of the treated intermediate and to prevent further thermal cracking of the treated intermediate, for example, at the outlet of the first channel 102 in the adsorbent separating region 112. In an implementation, the quenching medium maintains a temperature of the outlet of the first channel 102 within a range of about 500° C. to 550° C. As a result, the temperature of the treated intermediate is also maintained within this temperature range. Further, the temperature of the outlet of the first channel 102 may also be maintained by controlling the amount of adsorbent fed into the first channel 102.

Maintaining the temperature of the treated intermediate in the range of 500° C. to 550° C. at the outlet of the first channel 102 also helps in achieving a desired catalyst to feedstock ratio in the second channel 114 that is higher than what can be conventionally maintained. This is because, in the second channel 114, the treated intermediate is contacted with a catalyst, which is at a high temperature. As a result, the temperature of the treated intermediate increases in the second channel 114. However, to achieve effective catalytic cracking, the temperature of the second channel 114 has to be maintained within a desired temperature range of about 550° C. to 650° C. At higher temperatures, the coke formation on the catalyst increases, which adversely influences the catalytic cracking process.

Generally, the catalyst to feedstock ratio in the second channel 114 has to be reduced so that the temperature of the second channel 114 can be maintained within the desired range to achieve effective catalytic cracking of the feedstock. However, by maintaining the temperature of the treated intermediate in the range of 500° C. to 550° C. using quenching, the temperature of the second channel 114 can be maintained within the desired range even at a higher catalyst to feedstock ratio. Thus overall efficiency of cracking can be increased.

Further, a desired ratio of the adsorbent to the feedstock in the first channel 102 has to be maintained to achieve effective thermal cracking of the feedstock in the first channel 102. The high temperature adsorbent that enters the first channel 102 may disrupt the thermal cracking process. The temperature of the adsorbent is maintained within desired limits by providing a regenerator cooler at an adsorbent regenerator as will be explained later.

Further, the first channel 102 terminates in an adsorbent separating device 118 in the adsorbent separating region 112. In an implementation, the adsorbent separating device 118 may be an inertial separator, for example, a cyclone separator or a baffle plate separator. The adsorbent separating device 118 separates the treated intermediate from the spent adsorbent. The spent adsorbent flows through the adsorbent separating device 118 and towards an adsorbent stripping zone 120 of the adsorbent separating region 112.

In an embodiment, the adsorbent stripping zone 120 is provided at a bottom region of the adsorbent separating region 112 of the separator-reactor vessel 104. In other embodiments, the adsorbent stripping zone 120 may be provided at any appropriate elevation of the separator-reactor vessel 104. The adsorbent stripping zone 120 is supplied by a stripping medium, for example, steam, Nitrogen, or an inert gas, through an adsorbent stripping medium input 122 illustrated by an arrow in the figure. In an implementation, about 2 to 5 tonnes of the stripping medium is provided per 1000 tonnes of the spent adsorbent.

In the adsorbent stripping zone 120, the vapours of the treated intermediate entrained with the adsorbent particles are removed by the stripping medium. The spent adsorbent, substantially free from the treated intermediate, flows through a second standpipe 124. On the other hand, the vapours of the treated intermediate separated at the adsorbent separating device 118, and then at the adsorbent stripping zone 120 are directed through an overhead duct 126, and into the second channel 114. In said embodiment, the second channel 114 is a down-flow reactor.

According to an aspect of the present subject matter, inside the second channel 114, a uniform velocity distribution of the catalyst and the treated intermediate is obtained across a cross-section of the second channel 114. The uniform velocity distribution of the treated intermediate and the catalyst minimizes any side reactions, and hence minimizes formation of undesirable coke and dry gas in the second channel 114. Further, the second channel 114 is connected to a third standpipe 128 and is supplied with the catalyst through the third standpipe 128. The catalyst may include large pore zeolites, such as Y-zeolites; medium pore zeolites, such as ZSM-5 and ZSM-11; shape selective zeolite, such as ZSM-5; rare earth exchanged Y zeolite; Ultra stable Y zeolite; matrix zeolites; etc. Further, the catalyst may be amorphous or crystalline, and may be provided in the form of microspheres such that large surface area is exposed for reaction with the treated intermediate. Further, the small molecules present in the treated intermediate are capable of passing through the pores of the catalyst in order to achieve effective cracking.

The mixture of the treated intermediate and the catalyst is directed towards the second channel 114. The cracking of the treated intermediate is achieved in the second channel 114 to obtain a cracking yield, and the catalyst gets consumed due to contamination by wastes, such as coke. The cracking yield may include gasoline, light olefins, such as Ethylene, Propylene and Butylene, liquefied petroleum gas (LPG), etc.

Further, in an implementation, the residence time of the catalyst in the second channel 114 is about 1 to 5 seconds. In another implementation, the residence time of the catalyst in the second channel 114 is about 2 to 3 seconds. Further, in an implementation, the outlet of the second channel 114 is maintained in a temperature range of about 550° C. to 650° C. to achieve effective cracking of the treated intermediate. This is done, for example, by maintaining a catalyst to feedstock ratio in the second channel 114 within a range of about 3:1 to 15:1 by weight.

After the catalytic cracking, the cracking yield and the spent catalyst are carried further along the second channel 114 and into the catalyst separating region 116. In said embodiment, the catalyst separating region 116 includes a catalyst separating device 132 and a catalyst stripping zone 134. The catalyst separating device 132 may be similar to the adsorbent separating device 118. The spent catalyst is substantially removed from the cracking yield in the catalyst separating device 132, and the spent catalyst is directed towards the catalyst stripping zone 134 at a bottom of the catalyst separating region 116. The catalyst stripping zone 134 may, however, be provided at any appropriate elevation of the separator-reactor vessel 104. The catalyst stripping zone 134 is connected to a catalyst stripping medium input 136, illustrated by an arrow, and supplied with the stripping medium through the catalyst stripping medium input 136. In an implementation, about 2 to 5 tonnes of the stripping medium is provided per 1000 tonnes of the spent catalyst.

In the catalyst stripping zone 134, any residual vapours of the cracking yield entrained with the spent catalyst are removed, and the spent catalyst flows out from the catalyst separating region 116 of the separator-reactor vessel 104 through a fourth standpipe 138. The flow of the spent catalyst through the fourth standpipe 138 is regulated using a valve 140. The cracking yield is directed from the catalyst separating region 116 towards a fractionator (not shown in the figure) through a channel 142.

According to said embodiment of the present subject matter, the separator-reactor vessel 104 is provided with a physical partition 144. The physical partition 144 is disposed between the adsorbent separating region 112 from those of the catalyst separating region 116 separates the processes of the adsorbent separating region 112 from those of the catalyst separating region 116. The physical partition 144, hence, provides for a physically separate processing of the spent adsorbent and the spent catalyst. With such separate processing, the particle size of the adsorbent and the catalyst can be selected independent from each other. Such a separate processing of the adsorbent and the catalyst also prevents the catalyst from being exposed to a high concentration of contaminants, such as carbon residue and metal impurities that are present in the feedstock and adsorbed by the adsorbent, thereby enhancing the life of the catalyst. From the separator-reactor vessel 104, the spent catalyst is directed into a third channel 146 through the fourth standpipe 138.

The apparatus 100 further provides for regeneration of the spent adsorbent and the spent catalyst. To this end, the apparatus 100 includes an adsorbent regenerator 148 and a catalyst regenerator 150.

In an embodiment, the adsorbent regenerator 148 receives the spent adsorbent, free from entrained vapours of the treated intermediate, from the separator-reactor vessel 104 through the second standpipe 124. In said embodiment, the second standpipe 124 is provided with a valve 152 to regulate the flow of the spent adsorbent to the adsorbent regenerator 148. The spent adsorbent enters the adsorbent regenerator 148 and rests on a grid 154. Further, the adsorbent regenerator 148 is connected to a regenerating medium input 156. The regenerating medium input 156 supplies a regenerating medium, such as air or an Oxygen rich gas, to the adsorbent regenerator 148. In said embodiment, the regenerating medium input 156 terminates in the grid 154 of the adsorbent regenerator 148. The grid 154 forms a resting plane for the spent adsorbent as the regenerating medium is forced through the regenerating medium input 156. The grid 154 provides a greater surface for the adsorbent particles to be exposed to the regenerating medium, so that the regeneration of the adsorbent is achieved in large amounts.

In an implementation, the adsorbent regenerator 148 is operated in a partial combustion mode. In this mode of operation, the adsorbent regenerator 148 is operated under controlled flow of regenerating medium in dense bed fluidization regime. In one example, the adsorbent regenerator 148 is maintained below a temperature of about 700° C. in the partial combustion mode. In another example, the adsorbent regenerator 148 is maintained below a temperature of about 680° C. The temperature of the adsorbent regenerator 148 is maintained to maintain a desirable amount of carbonaceous deposit on the adsorbent. Usually, at higher concentration of carbonaceous deposits on the adsorbent, the ability of the adsorbent to trap the impurities present in the feedstock improves. Although there is no maximum limit on the amount of carbonaceous deposits on the adsorbent, however, due to practical reasons, the amount of carbonaceous deposits on the adsorbent within a range of about 0.3 to 2% by weight. In an embodiment, the adsorbent regenerator 148 may include a regenerator cooler (not shown in the figure) to maintain the temperature of the adsorbent regenerator 148, for example, when the feedstock has carbon residue in excess of 10% by weight, which causes a high concentration of the carbon residue to be adsorbed onto the adsorbent.

In another implementation, the adsorbent regenerator 148 may operate in a full combustion mode. In said implementation, the adsorbent regenerator 148 is operated by supplying excess amount of regenerating medium and the spent adsorbent is regenerated by full combustion of the contaminants therein.

In yet another implementation, the adsorbent regenerator 148 may operate in a gasification mode. Gasification is a chemical process used to convert a solid material such as the carbonaceous deposits into synthesis gas. In this mode of operation, the adsorbent regenerator 148 is operated at a temperature of about 750° C. to 850° C. In said implementation, the spent adsorbent is regenerated in presence of an Oxygen-containing gas and steam to produce Hydrogen, Carbon monoxide and Carbon dioxide. The steam reacts with the Carbon monoxide through the Water gas shift reaction. The metal impurities adsorbed on the spent adsorbent may act as catalyst for the Water gas shift reaction. The Hydrogen gas can be recovered at the downstream of the adsorbent regenerator 148 from the synthesis gas. The reaction is represented by the following chemical equation:

$$CO+H_2O \leftrightarrow CO_2+H_2$$

$$-\Delta H_{298}^{0}=41.2 \text{ kJ/mol}$$

Further, the adsorbent regenerator 148 includes a combustion product separating device 158, such as a cyclone separator or a baffle plate separator, to separate the adsorbent from the by-products, for example, combustion gases or products of gasification, in the adsorbent regenerator 148. The adsorbent is directed towards the first channel 102 through the first standpipe 108 for further treating the feedstock. The first standpipe 108 is provided with a valve 160 to regulate the amount of adsorbent supplied to the first channel 102. In an implementation, a ratio of the adsorbent to feedstock in the first channel 102 is maintained within a range of about 3:1 to about 15:1 by weight by regulating the flow of the adsorbent to the first channel 102 using the valve 160. Further the valve 160 also helps to maintain the outlet temperature of the riser within the temperature range of about 500° C. to 550° C. by controlling the adsorbent flow to the first channel 102 through the first standpipe 108.

Further, the catalyst regenerator 150 receives the spent catalyst through the third channel 146. In said embodiment, the third channel 146 is an upflow-type channel. The third channel 146 employs a lifting medium, such as air, to direct the spent catalyst, coming from the separator-reactor vessel 104, to the catalyst regenerator 146. In an implementation, the spent catalyst undergoes a partial regeneration in the third channel 146 as a portion of the contaminants in the spent catalyst burn when they contact the Oxygen present in the lifting medium. The spent catalyst, partially regenerated in the third channel 146, flows towards a grid 162 of the catalyst regenerator 150 and undergoes complete regeneration. The grid 162 is supplied with a regenerating medium, such as an Oxygen rich gas, through a regenerating medium input 164 to achieve complete combustion of the wastes in the catalyst. The grid 162 provides a large area to expose the spent catalyst for complete regeneration. Since, the contaminants in the feedstock are deposited on the adsorbent particles in the first channel 102, the coke lay down on the catalyst is substantially less. Therefore, the temperature of the catalyst regenerator 150 can be maintained within about 730° C. without using a catalyst cooler.

In another implementation, the contaminants in the spent catalyst undergo a partial combustion in the catalyst regenerator 150, that is, the catalyst regenerator 150 is operated in a partial combustion mode. In said implementation, a temperature of the catalyst regenerator 150 is maintained below about 700° C. by controlling excess Oxygen in combustion products.

Further, a mixture of the regenerated catalyst and combustion products, for example, exhaust gases and ash, enters a combustion product separation device 166 of the catalyst regenerator 150. The combustion product separation device 166 separates the spent catalyst from the combustion products. In an embodiment, the combustion product separation device 166 of the catalyst regenerator 150 is similar to the combustion product separating device 158 of the adsorbent regenerator 148.

The catalyst is supplied to the second channel 114 through the third standpipe 128, which is provided with a valve 168 to regulate the supply of the catalyst for cracking the treated intermediate. Further, the supply of the catalyst to the second channel 114 is regulated using the valve 168 in such a way that the catalyst to feedstock ratio of about 3:1 to 15:1 by weight is achieved. As mentioned earlier, the temperature of the outlet of the first channel 102 maintained by the quenching medium also helps in achieving the desired catalyst to feedstock ratio.

It may be understood that the valves 140, 152, 160 and 168 may or may not be implemented as similarly configured valves.

According to an aspect of the present subject matter, a gas purge (not shown in the figure) is provided in the first standpipe 108, the second standpipe 124, the third standpipe 128, and the fourth standpipe 138 to keep the adsorbent and the catalyst flowing and, hence, obtain an adsorbent stream and a catalyst stream.

Figure 2:
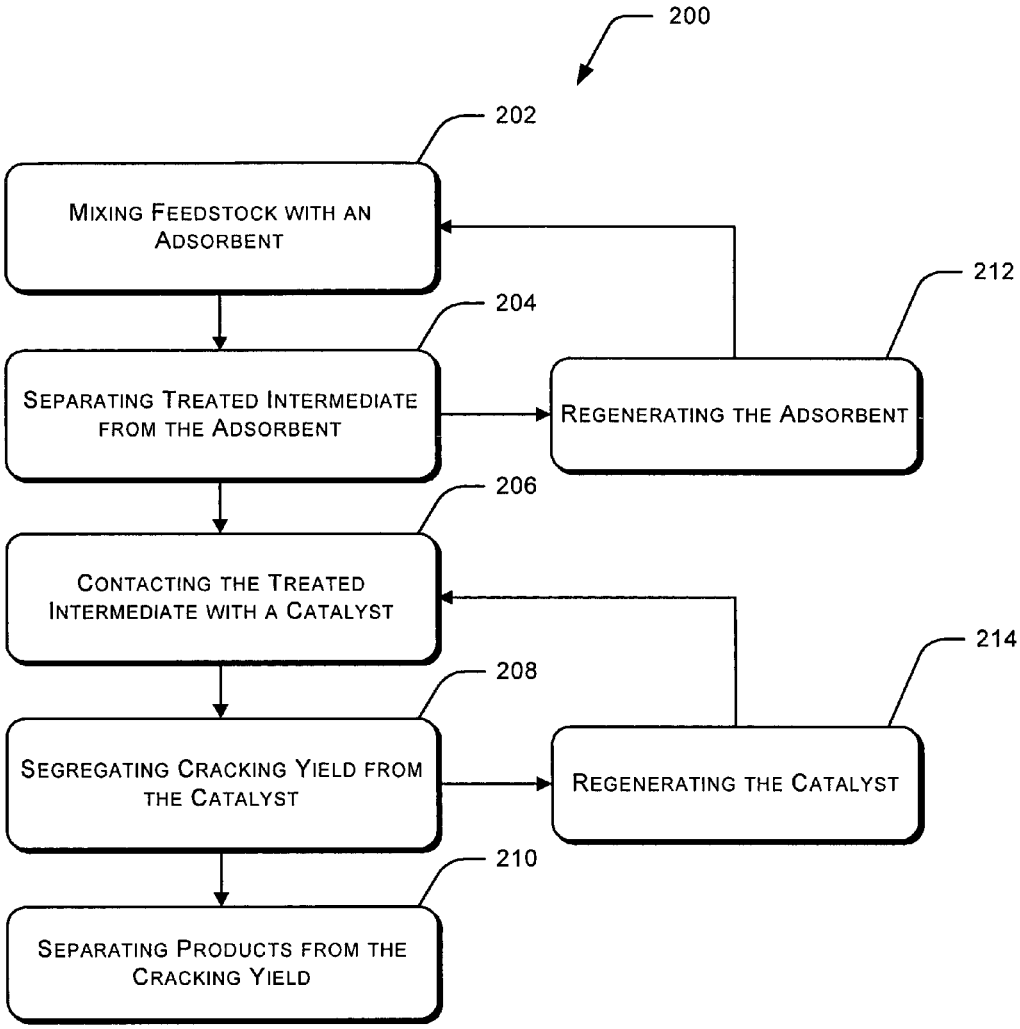
FIG. 2 illustrates an exemplary method for catalytic cracking of feedstock, according to an implementation of the present subject matter.

FIG. 2 illustrates an exemplary method for catalytic cracking of feedstock, according to an implementation of the present subject matter.

The order in which the method is illustrated in FIG. 2 is not intended to be construed as a limitation, and any number of the described method blocks can be combined in any order to implement the method, or an alternative method. Additionally, individual blocks may be deleted from the method without departing from the spirit and scope of the subject matter described herein.

Referring to FIG. 2, at block 202, an adsorbent is mixed with a feedstock. In an implementation, the feedstock is first mixed with a heated gas, for example, steam or an inert gas to assist in vaporization of the feedstock. In said implementation, the amount of heated gas in the mixture is about 10% to about 50% by weight. The heated gas and the feedstock form a flowing feedstock stream. The feedstock stream may be inducted into a channel, such as the first channel 102, through an input channel, such as the feedstock input 106. In an implementation, the first channel 102 is an upflow reactor. Further, the adsorbent is inducted into the first channel 102 through a standpipe, such as the first standpipe 108. A gas purge may be provided in the first standpipe 108 to obtain a flowing stream of the adsorbent. Furthermore, in an implementation, a particle size of the adsorbent is about 20 to 500 microns (μm), and a particle density of the adsorbent is about 1300 to 3000 kilogram per cubic meter (kg/m$^3$). In another implementation, the particle size of the adsorbent is about 20 to 200 microns (μm), and the particle density of the adsorbent is about 1300 to 1600 kilogram per cubic meter (kg/m$^3$). In yet another implementation, the particle size of the adsorbent is about 20 to 170 microns (μm), and the particle density of the adsorbent is about 1300 to 1400 kilogram per cubic meter (kg/m$^3$).

On mixing with the adsorbent, the feedstock may be fully vapourized and the contaminants, such as carbon residue, metal impurities, and Nitrogen and Sulphur compounds, in the feedstock get adsorbed on the adsorbent and are removed from the feedstock in the first channel 102. Further on contacting the adsorbent, the temperature of the feedstock increases and thermal cracking of the feedstock takes place. As the feedstock undergoes thermal cracking, heavy molecules of the feedstock are broken down into small molecules, which are capable of passing through small pores. Subsequent to the adsorption of the contaminants and the thermal cracking of the feedstock, a treated intermediate is obtained, which is composed from small molecules and is substantially free from the contaminants. The adsorbent gets spent in removing the contaminants from the feedstock, and is also referred to as spent adsorbent. In an implementation, the outlet temperature of the first channel 102 is maintained within a temperature range of about 500° C. to 550° C. by controlling the flow of adsorbent to the first channel 102 through a valve, such as the valve 160. Further, the outlet temperature of the first channel 102 may be maintained by providing a quenching medium, for example, steam, at an outlet of the first channel 102.

At block 204, the treated intermediate obtained at block 202 is separated from the spent adsorbent. In an implementation, the separation is achieved in a region, such as the adsorbent separating region 112, of a vessel, such as the separator-reactor vessel 104. The treated intermediate is separated from the spent adsorbent in a device, such as the adsorbent separating device 118, in the adsorbent separating region 112.

The spent adsorbent may include residual vapours of the treated intermediate entrained with it. These residual vapours are separated in a stripping zone, such as the adsorbent stripping zone 120, of the adsorbent separating region 112 of the separator-reactor vessel 104. The separation of the treated intermediate from the spent adsorbent is facilitated by a stripping medium, for example, steam or an inert gas, which is supplied to the stripping zone as a counter current through an input channel, such as the adsorbent stripping medium input 122.

At block 206, the stream of the treated intermediate is contacted with a catalyst to achieve cracking of the treated intermediate. The catalyst may be a porous catalyst and the small molecules present in the treated intermediate are capable of passing through the pores of the catalyst to achieve effective cracking of the treated intermediate. In an implementation, the catalyst from a channel, such as the third standpipe 128, is directed into a channel, such as the second channel 114. In an implementation, the second channel 114 is a down-flow reactor. A gas purge may be provided in the third standpipe 128 to provide a flowing stream of the catalyst. The cracking of the treated intermediate in the presence of the catalyst may occur in the second channel 114. In said implementation, an outlet of the second channel 114 is maintained at a temperature within a range of about 550° C. to 650° C. Further, in said implementation, a particle size of the catalyst is about 20 to 200 microns and a particle density of the catalyst is about 1200 to 1800 kilogram per cubic meter (kg/m$^3$). In another implementation, the particle size of the catalyst is about 20 to 170 microns and the particle density of the catalyst is about 1300 to 1600 kilogram per cubic meter (kg/m$^3$). In yet another implementation, the particle size of the catalyst is about 20 to 100 microns and the particle density of the catalyst is about 1300 to 1400 kilogram per cubic meter ($kg/m^3$). According to an aspect, an average particle size of the catalyst is of about 70 microns. Furthermore, the average particle size and the particle density of the catalyst are selected independent of the average particle size and the particle density of the adsorbent. In an implementation, the average particle size of the adsorbent is substantially same as the average particle size of the catalyst.

On cracking of the treated intermediate, a cracking yield including gasoline, light olefins, such as Ethylene, Propylene and Butylene, liquefied petroleum gas (LPG), etc., is obtained. The catalyst, on the other hand, is spent and deactivated because of its contamination by wastes, such as coke, during the cracking of the treated intermediate.

At block 208, the cracking yield is segregated from the spent catalyst. In an implementation, the cracking yield is segregated from the spent catalyst in a region, such as the catalyst separating region 116 of the separator-reactor vessel 104. The catalyst separating region 116 may include a separating device, such as the catalyst separating device 132, to separate the spent catalyst from the cracking yield. Further, the catalyst separating region 116 may also include a stripping zone, such as the catalyst stripping zone 134, to remove any residual vapours of the cracking yield entrained with the spent catalyst particles. The stripping zone may be supplied with a counter current of a stripping medium, such as steam, through a catalyst stripping medium input 136 to separate the entrained residual vapours of the cracking yield from the spent catalyst.

At block 210, the cracking yield segregated from the spent catalyst is processed further to separate the various products, such as gasoline, light olefins and liquefied petroleum gas (LPG). In an implementation, the cracking yield is processed in a fractionator to separate the various products.

At block 212, the spent adsorbent is regenerated. For example, the spent adsorbent is regenerated in a regenerator, such as the adsorbent regenerator 148, in the presence of a regenerating medium, such as an Oxygen rich gas, through a channel, for example, the regenerating medium input 156. In said implementation, the regeneration of the spent adsorbent is achieved by combustion of the contaminants on the adsorbent. In said implementation, the regeneration of the spent adsorbent is achieved by maintaining a temperature below about a temperature of 700° C. Further, amount of coke on the adsorbent after regeneration is limited to about 0.3 to 2% by weight. The adsorbent is again sent back to be contacted with the contaminated feedstock at block 202.

At block 214, the spent catalyst is regenerated for further use. In an implementation, the spent catalyst is regenerated in a regenerator, such as the catalyst regenerator 150, in the presence of a regenerating medium, such as an Oxygen rich gas, through a channel, for example, the regenerating medium input 164. In said implementation, the spent catalyst may be regenerated by combustion of wastes, such as coke, in the catalyst in the presence of the regenerating medium. Further, the regenerated catalyst has about 0.05 to 0.1% of coke by weight. The regenerated catalyst, also referred to as fresh catalyst, is again contacted with the treated intermediate to achieve cracking of the treated intermediate at block 206.

According to an implementation of the present subject matter, the separation of the treated intermediate at block 204, the contacting of the treated intermediate with the catalyst at block 206, and the segregation of the catalyst from the cracking yield at block 208, are achieved inside a single vessel, such as the separator-reactor vessel (104).

The described subject matter and its equivalent thereof have many advantages, including those which are described below. Since, the removal of the contaminants from the feedstock and the cracking of the treated intermediate are achieved separately, the catalyst is not exposed to a high concentration of contaminants, such as carbon residue and metal impurities, in the feedstock. As a result, the life of the catalyst is enhanced, and the catalyst addition rate and the cost of operation are considerably reduced. The overall performance of the catalyst is also enhanced. Further, since the catalyst is contacted with a treated intermediate, no catalyst cooler is required to maintain the temperature in a catalyst regenerator below the prescribed limit. Since, the contaminants in the feedstock are deposited on the adsorbent particles before the treated intermediate obtained by the thermal cracking of feedstock contacts the catalyst, the coke lay down on the catalyst is substantially less. Therefore, the temperature of the catalyst regenerator 150 can be maintained within the required range of temperature without a catalyst cooler.

Furthermore, since the spent adsorbent and the spent catalyst are also regenerated separately, the method is independent of the physical properties of the catalyst and the adsorbent, such as particle size, particle density, and fluidization, and is, hence, effective in terms of cost. Additionally, the adsorbent coming to the adsorbent regenerator 148 can be withdrawn from the adsorbent regenerator 148. Such an adsorbent may be laden with high concentration of metals, for example, about 50,000 parts per million of metals including Nickel, Vanadium, etc. These high value metals can be extracted from the adsorbent, before the regenerating medium is provided for the regeneration of the adsorbent.

Although the present subject matter has been described in considerable detail with reference to certain preferred embodiments thereof, other embodiments are possible. As such, the spirit and scope of the appended claims should not be limited to the description of the preferred embodiments contained therein.

The invention claimed is:

1. An apparatus comprising:

a first channel adapted to receive a feedstock stream comprising a feedstock, bring the same in contact with an adsorbent flow comprising an adsorbent and produce a treated intermediate, contacting of the feedstock steam with the adsorbent flow resulting in removal of contaminants from the feedstock stream via thermal cracking of the feedstock;

an adsorbent separating region in fluid flow communication with the first channel for receiving the treated intermediate and removing the adsorbent from the treated intermediate to form a treated intermediate stream;

a second channel being in fluid flow communication with the adsorbent separating region for receiving the treated intermediate stream, bring the same in contact with a catalyst flow comprising a catalyst and produce a cracking yield, contacting of the feedstock steam with the catalyst flow resulting in catalytic cracking of the intermediate stream; and a catalyst separating region being in fluid flow communication with the second channel for receiving the cracked yield and removing the catalyst from the treated cracked yield;

the adsorbent separating region, the second channel and the catalyst separating region being defined within a separator-reactor vessel with the adsorbent separating region and the catalyst separating region being separated from each other by a physical partition disposed within the separator-reactor vessel.

2. The apparatus as claimed in claim 1, wherein the adsorbent separating region comprises:

an adsorbent separating device for receiving the treated intermediate and removing the adsorbent from the treated intermediate to form a treated intermediate stream; and an adsorbent stripping zone located beneath the adsorbent separating device for receiving the adsorbent from the adsorbent separating device and removing a residual treated intermediate from the same.

3. The apparatus as claimed in claim 1, wherein the wherein the catalyst separating region comprises:

a catalyst separating device for receiving the cracking yield and removing therefrom the catalyst; and a catalyst stripping zone located beneath the catalyst separating device for receiving the catalyst from the catalyst separating device and removing a residual cracking yield from the same.

4. The apparatus as claimed in claim 1, wherein the second channel is a down-flow reactor.

5. The apparatus as claimed in claim 2, further comprising an adsorbent regenerator connected to the adsorbent stripping zone for receiving there from a spent adsorbent and regenerating the spent adsorbent with regenerating medium containing oxygen.

6. The apparatus as claimed in claim 3, further comprising a catalyst regenerator connected to the catalyst stripping zone for receiving therefrom a spent catalyst and regenerating the spent catalyst with regenerating medium containing oxygen.

7. A method comprising:

contacting a feedstock stream comprising a feedstock, with an adsorbent flow comprising an adsorbent, in a first channel to remove contaminants from the feedstock stream by the adsorbent and to thermally crack the feedstock to produce a treated intermediate;

separating the treated intermediate from the adsorbent in an adsorbent separating region to form a treated intermediate stream;

contacting the treated intermediate stream with a catalyst flow comprising a catalyst in a second channel to catalytically crack the treated intermediate in the treated intermediate stream in presence of the catalyst to produce a cracking yield; and segregating the catalyst from the cracking yield in a catalyst separating region;

wherein the separating, the contacting, and the segregating are achieved in a single separator-reactor vessel defining the adsorbent separating region, the second channel and the catalyst separating region, with the adsorbent separating region and the catalyst separating region being separated from each other by a physical partition disposed within the separator-reactor vessel.

8. The method as claimed in claim 7, wherein separating the treated intermediate stream further comprises removing residual feedstock from the adsorbent.

9. The method as claimed in claim 8, wherein the removing comprises providing a counter current of a stripping medium.

10. The method as claimed in claim 7, wherein the separating the cracking yield further comprises removing residual cracking yield from the catalyst.

11. The method as claimed in claim 10, wherein the removing comprises providing a counter current of a stripping medium.

12. The method as claimed in claim 7, wherein an average particle size of the adsorbent is substantially same as an average particle size of the catalyst.

13. The method as claimed in claim 7, wherein a residence time of the adsorbent in the first channel is about 2 to 5 seconds.

14. The method as claimed in claim 7, wherein a residence time of the catalyst in the second channel is about 2 to 3 seconds.

15. The method as claimed in claim 7, wherein an outlet of the first channel is maintained in a temperature range of about 500° C. to 550° C.

16. The method as claimed in claim 7, wherein an outlet of the second channel is maintained in a temperature range of about 550° C. to 650° C.

17. The method as claimed in claim 7, wherein a ratio of the adsorbent to feedstock in the first channel ranges from about 3:1 to about 15:1 by weight.

18. The method as claimed in claim 7, wherein a ratio of the catalyst to feedstock in the second channel ranges from about 3:1 to about 15:1 by weight.

19. The method as claimed in claim 7, wherein the adsorbent regenerator is operated in a partial combustion mode below a temperature of about 680° C.

20. The method as claimed in claim 7, wherein the adsorbent regenerator is operated in a full combustion mode.

21. The method as claimed in claim 7, wherein the adsorbent regenerator is operated in a gasification mode at a temperature of about 750° C. to 850° C.

22. The method as claimed in claim 7, wherein the catalyst regenerator is maintained below a temperature of about 700° C.

* * * * *

UNITED STATES PATENT AND TRADEMARK OFFICE

CERTIFICATE OF CORRECTION

PATENT NO. : 8,840,846 B2
APPLICATION NO. : 13/638509
DATED : September 23, 2014
INVENTOR(S) : Bhattacharyya et al.

It is certified that error appears in the above-identified patent and that said Letters Patent is hereby corrected as shown below:

On the Title Page, item 73, in Column 1, Line 1, delete "Kolkata" and insert -- Faridabad --, therefore.

Signed and Sealed this
Twenty-seventh Day of October, 2015

Michelle K. Lee

Michelle K. Lee
*Director of the United States Patent and Trademark Office*